US008073362B2

(12) United States Patent
Deguchi

(10) Patent No.: US 8,073,362 B2
(45) Date of Patent: Dec. 6, 2011

(54) PHOTOSENSITIVE BODY HAVING ELECTRICAL CONNECTION ARRANGEMENT

(75) Inventor: Hideaki Deguchi, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 474 days.

(21) Appl. No.: 12/372,933

(22) Filed: Feb. 18, 2009

(65) Prior Publication Data

US 2009/0226216 A1 Sep. 10, 2009

(30) Foreign Application Priority Data

Mar. 10, 2008 (JP) ..... 2008-059233

(51) Int. Cl.
*G03G 15/00* (2006.01)

(52) U.S. Cl. ..... 399/159; 399/90

(58) Field of Classification Search ..... 399/90, 399/111, 117, 159
See application file for complete search history.

(56) References Cited

U.S. PATENT DOCUMENTS

| | | | | |
|---|---|---|---|---|
| 4,656,965 | A | 4/1987 | Hosoya et al. | |
| 4,839,690 | A | 6/1989 | Onoda et al. | |
| 5,752,136 | A | 5/1998 | Sanchez et al. | |
| 5,903,803 | A | 5/1999 | Kawai et al. | |
| 5,943,527 | A | 8/1999 | Kashiwagi et al. | |
| 5,953,562 | A * | 9/1999 | Kawaguchi et al. | 399/117 |
| 6,167,219 | A | 12/2000 | Miyamoto et al. | |
| 6,175,706 | B1 | 1/2001 | Watanabe et al. | |
| 6,226,478 | B1 | 5/2001 | Watanabe et al. | |
| 6,240,266 | B1 | 5/2001 | Watanabe et al. | |
| 6,400,914 | B1 | 6/2002 | Noda et al. | |
| 6,785,489 | B2 | 8/2004 | Anderson, II | |
| 6,922,536 | B2 | 7/2005 | Arimitsu et al. | |
| 7,020,410 | B2 * | 3/2006 | Zogg et al. | 399/90 |
| 7,463,846 | B2 * | 12/2008 | Nishimura | 399/117 |
| 2009/0226214 | A1 | 9/2009 | Deguchi | |
| 2009/0226215 | A1 | 9/2009 | Deguchi | |

FOREIGN PATENT DOCUMENTS

| | | |
|---|---|---|
| CN | 101308342 A | 11/2008 |
| JP | 10-207291 | 8/1998 |

(Continued)

OTHER PUBLICATIONS

David R. Lide, Ph.D., CRC Handbook of Chemistry and Physics, 2001-2002, CRC Poress LLS, 82nd Edition, p. 10-175.

Non-Final Office Action dated Mar. 14, 2011 in U.S. Appl. No. 12/372,923.

Final Office Action dated Jun. 16, 2011 in U.S. Appl. No. 12/372,923.

*Primary Examiner* — Hoang Ngo

(74) *Attorney, Agent, or Firm* — Banner & Witcoff, Ltd.

(57) ABSTRACT

A photosensitive body for electro-photography includes a photosensitive drum, a shaft aligned with a center axis of the photosensitive drum, and a contact member. The photosensitive drum is rotatable relative to the shaft, and the shaft includes a cylindrical shaft body made from an electrically conductive metal, and an electrically conductive metal coating formed on an outer surface of the shaft body. The contact member has an engagement portion in fitting engagement with an inner peripheral surface of the drum body, and a contact portion resiliently and slidingly contacting the shaft to provide an electrical contact between the photosensitive drum and the shaft. The metal coating and at least a surface of the contact portion in direct contact with the outer surface of the shaft body are made from a material identical to each other.

15 Claims, 3 Drawing Sheets

FOREIGN PATENT DOCUMENTS

| | | |
|---|---|---|
| JP | 10-240103 | 9/1998 |
| JP | 2002-91234 | 3/2002 |
| JP | 2004-102270 | 4/2004 |
| JP | 2006-072039 | 3/2006 |

* cited by examiner

PHOTOSENSITIVE BODY HAVING ELECTRICAL CONNECTION ARRANGEMENT

CROSS REFERENCE TO RELATED APPLICATION

This application claims priority from Japanese Patent Application No. 2008-059233 filed Mar. 10, 2008. The entire content of the priority application is incorporated herein by reference.

TECHNICAL FIELD

The present invention relates to a photosensitive body for an electro-photography, and more particularly, to an electrically connecting arrangement in the photosensitive body.

BACKGROUND

A conventional photosensitive body installed in a process cartridge detachable relative to a main frame of an image forming device such as a copying machine, printer, and facsimile is generally in the form of a cylindrical shape having a small diameter. The photosensitive body includes a cylindrical electrically conductive photosensitive drum, an electrically conductive shaft rotatably supporting the photosensitive drum, and an electrically conductive contact member.

The photosensitive drum includes a drum body (aluminum tube) whose outer surface is formed with a photosensitive layer. Further, an end flange is fitted at each end of the aluminum tube. The shaft extends through a radial center of each flange. One of the flanges is provided with a gear for drivingly rotating the photosensitive body about its axis.

In such conventional photosensitive body, the end flange is made from a synthetic resin in view of reduction in weight and cost. Here, in the electro-photographic process, the drum body must be electrically connected to the main frame because of the necessity of grounding. To this effect, the contact member such as an electrically conductive plate (grounding plate) is provided for electrical connection between the shaft and the drum body.

More specifically, the electrically conductive plate has generally disk shape and is forth-fitted with inner peripheral side of the end portion of the drum body along with the end flange. The electrically conductive disk plate has an outer peripheral portion provided with a protrusion adapted to be in contact with the drum body, and has a radially center portion formed with a through-hole through which the shaft extends. The electrically conductive disk plate has a reed like contact portion that is in resilient contact with an outer peripheral surface of the shaft extending through the through-hole. Such conventional arrangement is described in laid open Japanese Patent Application Publication No. H10-207291, 2002-91234, 2004-102270, and 2006-72039.

SUMMARY

Stability in electric conductivity between the shaft and the contact member is lowered or degraded due to frictional contact therebetween as a result of operation of the image forming device for a prolonged period of time. Such drawback occurs due to formation of oxide upon corrosion at the slide-contacting portion between the shaft and the contact member. For example, seams or streak lines extending in parallel with a main scanning direction will be generated in the image at each rotation cycle of the photosensitive body, i.e., at each relative rotation cycle between the shaft and the contact member due to the deposition of the oxide onto the shaft.

In view of the foregoing, it is an object of the invention to provide a photosensitive body for electro-photography capable of providing stabilized electrical connection between the shaft and the drum body, thereby stabilizing image formation with high quality.

This and other objects of the present invention will be attained by providing a photosensitive body for electro-photography including a photosensitive drum, a shaft and a contact member. The photosensitive drum includes a drum body made from an electrically conductive material, and, a photosensitive layer formed on an outer peripheral surface of the drum body. The shaft is aligned with a center axis of the drum body. The photosensitive drum is rotatable relative to the shaft. The shaft includes a cylindrical shaft body made from an electrically conductive metal, and an electrically conductive ++ formed on an outer surface of the shaft body. The contact member has an engagement portion in fitting engagement with the inner peripheral surface of the drum body, and a contact portion resiliently and slidingly contacting the shaft to provide an electrical contact between the photosensitive drum and the shaft. The metal coating and at least a surface of the contact portion in direct contact with the outer surface of the shaft body are made from a material identical to each other.

In another aspect of the invention, there is provided a photosensitive body for electro-photography including the photosensitive drum, a shaft and the contact member. The shaft is aligned with a center axis of the drum. The photosensitive drum is rotatable relative to the shaft. The shaft includes a cylindrical shaft body made from an electrically conductive metal, and an electrically conductive metal coating formed on an outer surface of the shaft body and made from copper. The contact member has an engagement portion in fitting engagement with the inner peripheral surface of the drum body, and a contact portion resiliently and slidingly contacting the shaft to provide an electrical contact between the photosensitive drum and the shaft. The contact member is an integral product made from phosphor bronze.

DETAILED DESCRIPTION

Figure 1:
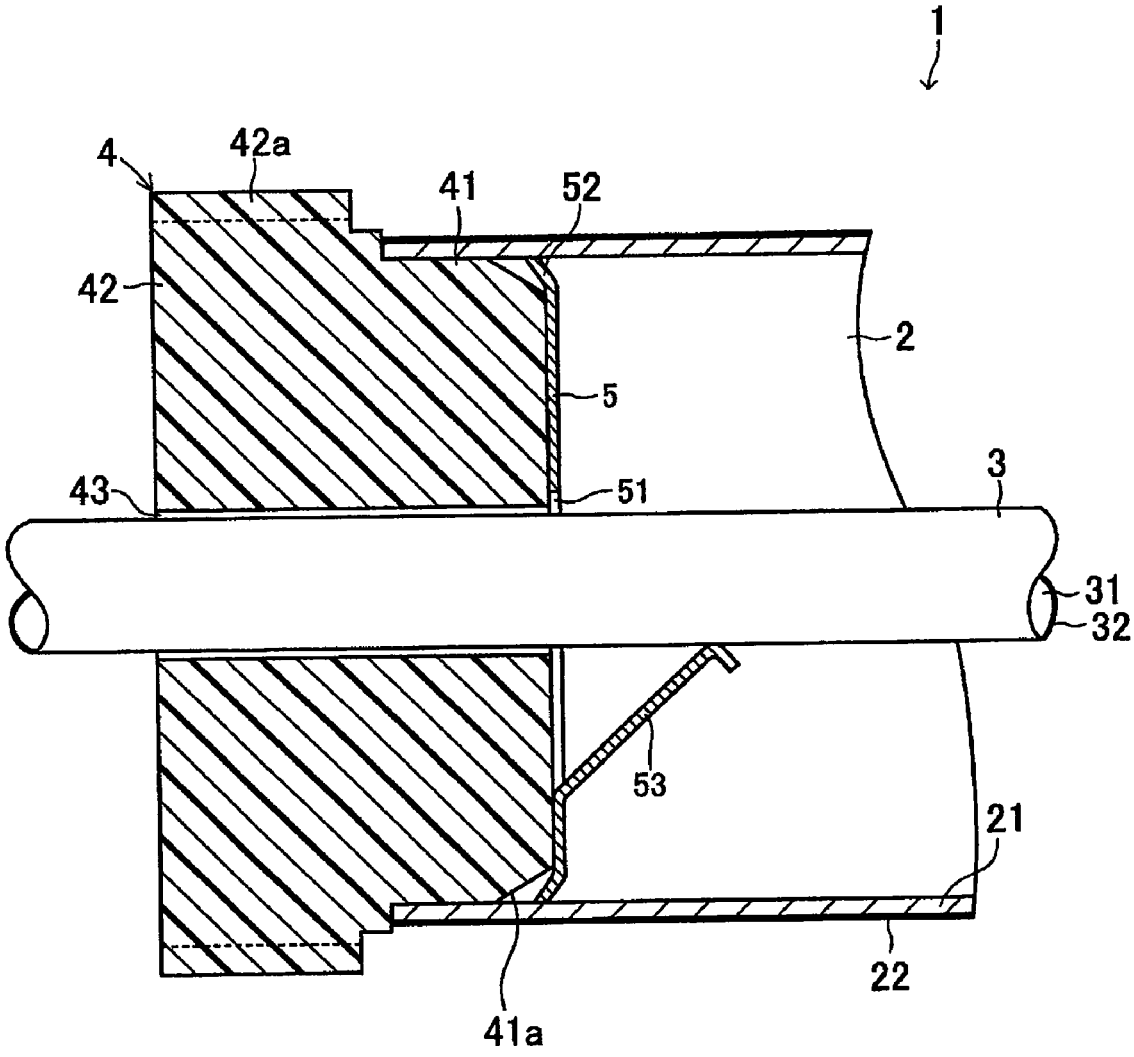
FIG. 1 is a cross-sectional view showing an essential portion of a photosensitive body according to a first embodiment of the invention.

A photosensitive body according to a first embodiment of the invention will be described with reference to FIG. 1. The photosensitive body 1 includes a photosensitive drum 2, a shaft 3, end flanges 4 and a contact plate 5.

The photosensitive drum 2 includes a hollow cylindrical drum body 21 made from aluminum, and a photosensitive layer 22 formed on an outer peripheral surface of the drum body 21. The drum body 21 has each open end fitted with each end flange 4. Further, the contact plate 5 is fixed to one end of the drum body along with the end flange 4. The shaft 3 rotatably extends through the end flanges 4, so that the photosensitive drum 2, the end flanges 4, and the contact plate 5 are rotatable relative to the shaft 3.

The shaft 3 is disposed concentrically with the photosensitive drum 2. The shaft 3 includes a solid cylindrical shaft body 31 made from a stainless steel and a metal coating 32 formed over an outer peripheral surface of the shaft body 31. The metal coating 32 is adapted to provide sufficient electrical connection, by way of frictional contact, between the shaft 3 and the contact plate 5. The metal coating 32 is formed by plating with copper.

The end flange 4 is of a cylindrical shape and made from synthetic resin. The end flange 4 has a small diameter portion 41 force-fitted with an inner peripheral surface of the photosensitive drum 2 at its open end portion, and a large diameter portion 42 having an outer diameter greater than that of the small diameter portion 41 and the photosensitive drum 2. A gear 42*a* is provided at an outer peripheral side of the large diameter portion 42 for engagement with a drive gear (not shown) for rotating the photosensitive drum 2 and the end flange 4 about a central axis. A through-hole 43 is formed in the end flange 4 to allow the shaft 3 to extend therethrough. The through-hole 43 is concentric with the end flange 4, so that the photosensitive drum 2 can be rotated about the central axis of the shaft 3. The small diameter portion 41 has a distal end formed with a tapered portion 41*a*.

The contact plate 5 is an integral component and has a generally disk-like shape. The contact plate 5 is produced by punching and press-forming a metal plate such as a stainless plate subjected to plating with copper. The contact plate 5 has a center portion formed with a center hole 51 concentrically therewith to allow the shaft 3 to extend through the hole 51, and has an outer peripheral portion provided with a plurality of engagement protrusions 52 protruding radially outwardly. These engagement protrusions 52 are resiliently deformable and are brought into engagement with the inner peripheral surface of the drum body 21 when the small diameter portion 41 of the end flange 4 is force-fitted with the photosensitive drum 2, while the contact plate 5 is in contact with the distal end face of the inner diameter portion 41. During sliding movement of the small diameter portion 41, the radially outer end portion of each engagement protrusion 52 is also in sliding contact with the inner surface of the drum body 21. Thus, the engagement protrusion 52 is urged to be bent. The tapered surface 41*a* can permit the engagement protrusion 52 to be easily bent.

The contact plate 5 has a contact segment 53 in the form of a leaf spring at a position near the hole 51 and extending from the disk like region of the contact plate 5. The contact segment 53 has a free end in resilient sliding contact with the outer peripheral surface of the shaft 3 when the shaft 3 is inserted through the through-hole 4 and the hole 51 while the end flange 4 and the contact plate 5 are assembled to the photosensitive drum 2. The contact segment 53 is formed by press-forming.

In this way, the contact plate 5 is fixed to the photosensitive drum 2 through the engagement protrusions 52, and electrical connection between the drum body 21 and the shaft 3 can be made by way of the engagement protrusions 52 and the contact segment 53.

With this structure, during image formation process, the photosensitive drum 2 is rotated relative to the shaft 3, so that the contact segment 53 is in sliding contact with the metal coating 32 formed on the outer peripheral surface of the shaft body 31.

Here, corrosion at the mutually contacting portions may not occur, since the metal coating 32 and the surface layer of the contact segment 53 are both made from copper. This is high contrast to a case where the mutually contacting portions are made from materials different from each other. Further, exclusive frictional wearing, for example, exclusive wearing of only the metal coating 32 due to the sliding friction to expose the internal shaft body 31 (a surface of stainless steel) to an atmosphere can be effectively eliminated. Consequently, any formation of the oxide film at the exposed portion of the shaft body 31 can be prevented or restrained. Consequently, smooth frictional contact of the contact segment 53 with the shaft 3 can be maintained, thereby maintaining stable electrical connection between the photosensitive drum 2 and the shaft 3.

Figure 2:
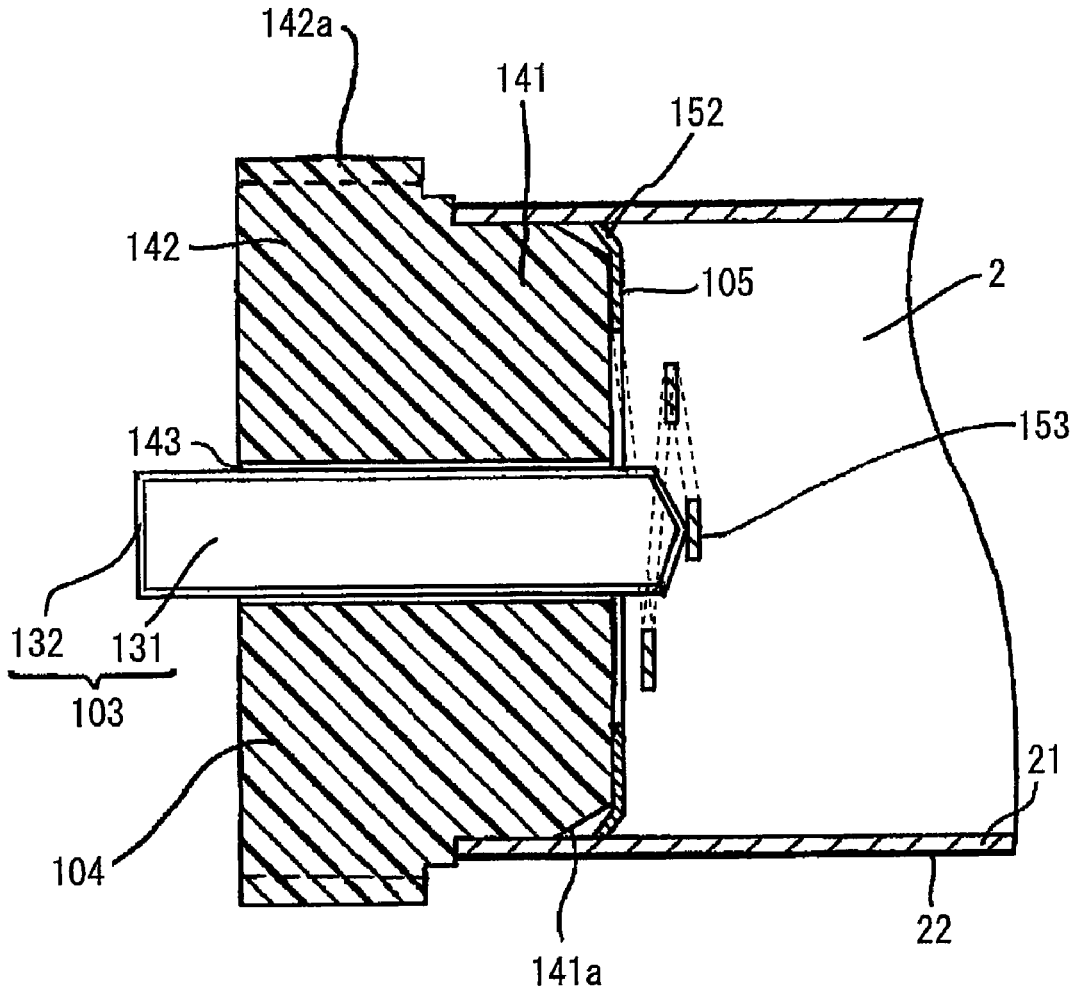
FIG. 2 is a cross-sectional view showing an essential portion of a photosensitive body according to a second embodiment of the invention.

Next, a photosensitive body according to a second embodiment of the invention will be described with reference to FIGS. 2 and 3, wherein like parts and components are designated by reference numerals added with "100" to the reference numerals in FIG. 1. In the photosensitive body according to the first embodiment, the shaft 3 extends throughout the photosensitive drum 2. In contrast, according to the second embodiment, two shafts 103 are provided each extending through each end flange 104 concentrically therewith. Further, in the first embodiment, the contact segment 53 of the contact plate 5 is in sliding contact with the outer peripheral surface of the shaft 3. On the other hand, in the second embodiment, a contact segment 153 is in sliding contact with an internal axial end face of a shaft 103. "Internal" implies that the end face located inside the drum body 21.

More specifically, a large diameter portion 142 of the flange 104 is rotatably supported to a casing (not shown) through a bearing (not shown). Each shaft 103 includes a shaft body 131 and a metal coating 132 formed over an entire outer surface of the shaft body 131. The shaft body 131 has the internal axial end face having a conical shape, and the metal coating 132 is also formed over the conical surface. An apex of the cone is a distal end.

Figure 3:
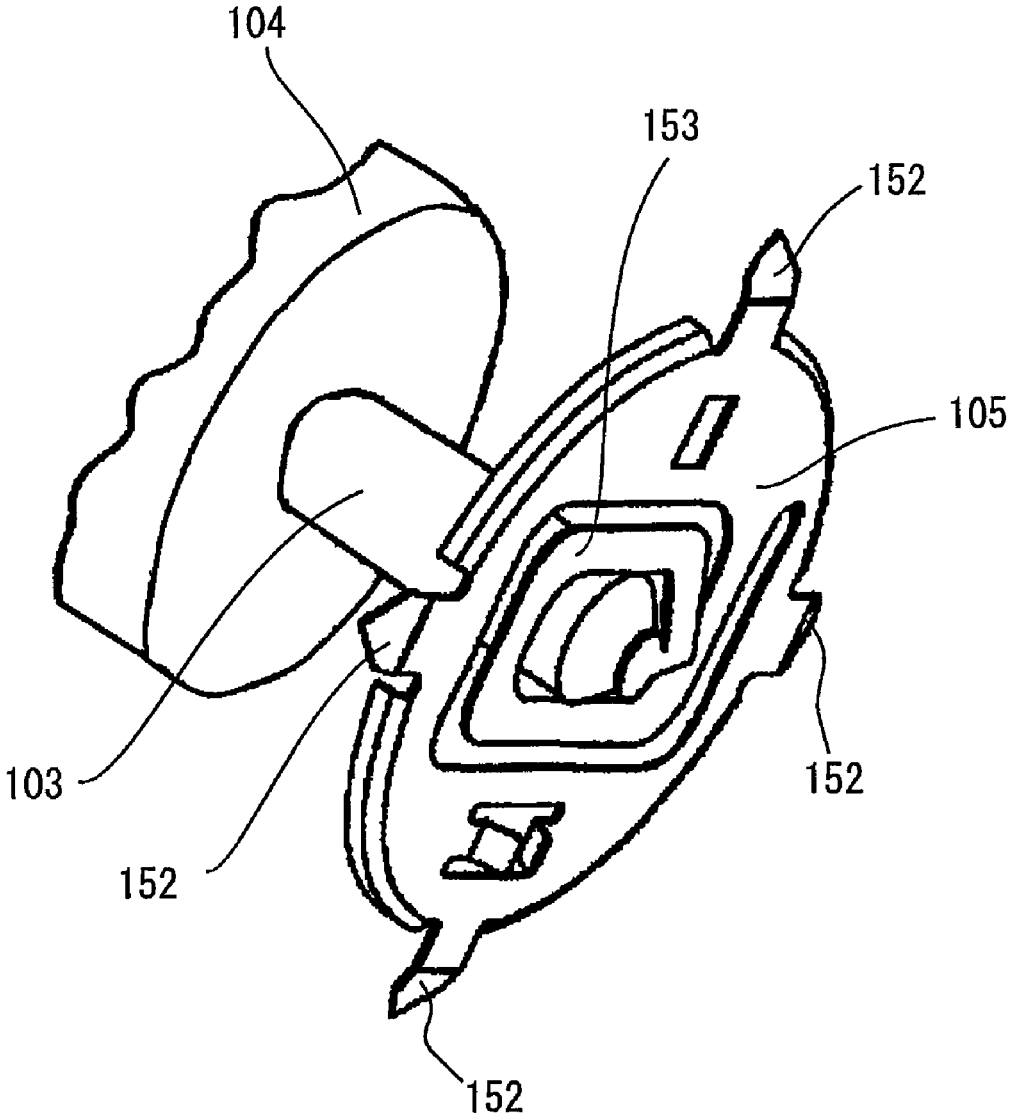
FIG. 3 is a perspective view showing assembly of the photosensitive body according to the second embodiment.

As shown in FIG. 3, a contact plate 105 has engagement protrusions 152 to be fitted with the photosensitive drum (not shown). The contact segment 153 has a scroll like configuration whose free end is in contact with the internal apex end of shaft 103 for electrical connection between the shaft 103 and the photosensitive drum 2 through the contact plate 105.

Various modifications are conceivable. For example, the metal coating 32 can be a copper layer, and the contact plate 5, 105 can be formed by press-forming a metal plate made from phosphor bronze. According to this modification, generation of corrosion at the mutually contacting portions can be restrained, since substrate or main composition of the metal coating and the contact plate are both copper.

Further, shape of the end flange 4, shape, material, and number of the contact segment 53 are not limited to the above-described embodiment. For example, in the second embodiment, the inner axial end face has conical shape. However, a flat end face extending perpendicular to the axial direction of the shaft 103, or arcuate or semi-spherical shape are also available. In such cases, the contact segment should be in contact with the inner flat end face or arcuate or semi-spherical surface of the shaft. Further, in the second embodiment, the metal coating 132 is formed over the entire outer surface of the shaft body 131. However, the metal coating can be formed at least on the end face.

Further, the copper plating onto the contact plate 5 can be limited to a contact portion of the contact segment 53, 153 relative to the shaft 3 in the above-described embodiments. However, copper plating can be formed over an entire outer surface of the contact plate 5, 105 to reduce production cost.

Further, the contact plate 5, 105 can be formed by copper plate or copper alloy plate such as phosphor bronze plate. In this case, copper plating over a surface of the contact plate 5, 105 is not required. Alternatively, nickel is available as a material of the metal coating 32. In this case, a portion of the contact segment in contact with the metal coating should be made from nickel.

Further, the metal coating 32 can be formed by coating, vapor deposition or other method instead of plating. However, plating is preferable in light of production cost, and control to a thickness and surface roughness of the metal coating. Further, the contact plate 5, 105 can be produced by wire-cutting to a metal plate instead of press-forming to provide an integral structure of the contact plate without any seam.

While the invention has been described in detail with reference to the specific embodiment thereof, it would be apparent to those skilled in the art that various changes and modifications may be made therein without departing from the spirit of the invention.

What is claimed is:

1. A photosensitive body for electro-photography comprising:

a photosensitive drum comprising a drum body made from an electrically conductive material, the drum body having an outer peripheral surface and an inner peripheral surface, and defining a center axis; and, a photosensitive layer formed on the outer peripheral surface;

a shaft aligned with the center axis, the photosensitive drum being rotatable relative to the shaft, and the shaft comprising a cylindrical shaft body made from an electrically conductive metal and having an outer surface, and an electrically conductive metal coating formed on the outer surface of the shaft body; and a contact member having an engagement portion in fitting engagement with the inner peripheral surface of the drum body, and a contact portion resiliently and slidingly contacting the shaft to provide an electrical contact between the photosensitive drum and the shaft, the metal coating and at least a surface of the contact portion in direct contact with the outer surface of the shaft body being made from a material identical to each other.

2. The photosensitive body as claimed in claim 1, wherein the contact member is an integral product made from the identical material in its entirety.

3. The photosensitive body as claimed in claim 2, wherein the identical material is nickel.

4. The photosensitive body as claimed in claim 2, wherein the identical material is copper.

5. The photosensitive body as claimed in claim 1, wherein the metal coating comprises a plating layer.

6. The photosensitive body as claimed in claim 1, wherein the shaft body is made from stainless steel.

7. The photosensitive body as claimed in claim 1, wherein the metal coating is formed on the outer peripheral surface of the shaft body, the contact portion being in contact with the metal coating on the outer peripheral surface.

8. The photosensitive body as claimed in claim 1, wherein the shaft body has an axial end face serving as the outer surface, the metal coating being formed on the axial end face, the contact portion being in contact with the metal coating on the axial end face.

9. The photosensitive body as claimed in claim 8, wherein the photosensitive drum has open ends, and the photosensitive body further comprising first end flange and second end flange each fitted with each open end; and wherein the shaft comprises a first shaft rotatably extending through the first flange and having the axial end face at an internal space of the drum body, and a second shaft rotatably extending through the second flange and having the axial end face at the internal space of the drum body, the contact portion being in contact with the metal coating on the axial end face at the internal space.

10. The photosensitive body as claimed in claim 1, wherein the photosensitive drum has open ends, and the photosensitive body further comprising end flanges fitted with open ends, respectively, the shaft being rotatably supported by the end flanges.

11. The photosensitive body as claimed in claim 10, wherein the engagement portion is fixed to the inner peripheral surface of the drum body in co-operation with the end flange.

12. The photosensitive body as claimed in claim 11, wherein the contact portion has a base portion in contact with the end flange, the engagement portion and the contact portion integrally extending from the base portion.

13. A photosensitive body for electro-photography comprising:

a photosensitive drum comprising a drum body made from an electrically conductive material, the drum body having an outer peripheral surface and an inner peripheral surface, and defining a center axis; and, a photosensitive layer formed on the outer peripheral surface;

a shaft aligned with the center axis, the photosensitive drum being rotatable relative to the shaft, and the shaft comprising a cylindrical shaft body made from an electrically conductive metal and having an outer surface, and an electrically conductive metal coating formed on the outer surface of the shaft body and made from copper; and a contact member having an engagement portion in fitting engagement with the inner peripheral surface of the drum body, and a contact portion resiliently and slidingly contacting the shaft to provide an electrical contact between the photosensitive drum and the shaft, the contact member being an integral product made from phosphor bronze.

14. The photosensitive body as claimed in claim 13, wherein the metal coating comprises a plating layer.

15. The photosensitive body as claimed in claim 13 wherein the shaft body is made from stainless steel.

* * * * *